US005984753A

United States Patent [19]

Perez

[11] Patent Number: 5,984,753

[45] Date of Patent: Nov. 16, 1999

[54] AERODYNAMIC TOY

[76] Inventor: Charles G. Perez, 3614 E. 5th St., Tucson, Ariz. 85716

[21] Appl. No.: 09/221,609

[22] Filed: Dec. 22, 1998

Related U.S. Application Data

[63] Continuation-in-part of application No. 08/870,227, Jun. 6, 1997, abandoned.

[51] Int. Cl.[6] ..... A63H 27/00; A63B 65/10

[52] U.S. Cl. ..... 446/46; 473/588

[58] Field of Search ..... 446/46, 47, 98, 446/385; 482/21, 77; 473/569, 588, 594, 595

[56] References Cited

U.S. PATENT DOCUMENTS

| | | | |
|---|---|---|---|
| 810,352 | 1/1906 | Sackett | 473/588 |
| 1,134,008 | 3/1915 | Reach | 482/21 |
| 1,492,976 | 5/1924 | Gill | 482/21 |
| 2,744,356 | 5/1956 | Killinger et al. . | |
| 3,359,000 | 12/1967 | Schreiber | 446/46 X |
| 3,416,800 | 12/1968 | Randall | 473/588 |
| 3,541,192 | 11/1970 | Shapero et al. | 446/385 X |
| 3,710,503 | 1/1973 | Rylands | 446/489 |
| 3,710,505 | 1/1973 | Linenfelser | 446/46 |
| 3,716,229 | 2/1973 | Van Der Cleyen et al. | 482/77 |
| 3,758,985 | 9/1973 | Heisler . | |
| 3,855,728 | 12/1974 | Hynds . | |
| 4,077,155 | 3/1978 | Bruntmyer . | |
| 4,196,540 | 4/1980 | Hembree et al. | 446/46 |
| 4,301,616 | 11/1981 | Gudgel . | |
| 4,580,990 | 4/1986 | Avery | 446/46 |
| 4,894,038 | 1/1990 | Giese . | |
| 4,944,707 | 7/1990 | Silverglate . | |
| 5,360,363 | 11/1994 | Levin | 446/46 |
| 5,480,143 | 1/1996 | McMurry . | |
| 5,490,047 | 2/1996 | O'Rourke et al. . | |
| 5,522,780 | 6/1996 | Roddy | 473/588 X |
| 5,674,101 | 10/1997 | Saloor | 446/46 |

*Primary Examiner*—D Neal Muir
*Attorney, Agent, or Firm*—Antonio R. Durando; Jean M. Barkley

[57] ABSTRACT

A piece throwable toy is disclosed that combines the features of a disk-shaped flying toy with the features of a ball or rounded toy. Specifically, the toy comprises a disk-shaped portion circumscribed by a rim, with the rim having a topside lying in a first plane and a bottom side lying in a second plane that is substantially parallel to the first plane. The ball-like feature of the toy is provided by a pair of like-shaped convexities that protrude from the first and second planes in an opposing fashion and that join the disk-shaped portion. Each of the convexities is concentric to the circular rim of the toy. The resulting toy has the appearance of a "flying saucer" and may be thrown like a Frisbee™ or kicked like a ball, thereby offering a unique play experience.

20 Claims, 3 Drawing Sheets

AERODYNAMIC TOY

RELATED APPLICATIONS

This is a continuation in part of Application Ser. No. 08/870,227, now abandoned filed on Jun. 6, 1997, by the same inventor.

TECHNICAL FIELD

This present invention relates to aerodynamic toys intended to be thrown through the air such that they rotate about their axes during flight and, more particularly, to an aerodynamic toy in the general form of a disk having like-shaped semi-spherical convexities protruding from its opposing planes, with the circumference of the disk serving as a handhold for throwing and catching the toy.

BACKGROUND ART

The field of aerodynamic toys includes such well-known products as the Frisbee™ flying disk, which is a saucer-shaped device that can be thrown over relatively long distances. To propel the Frisbee™, one grasps its edge while flexing the wrist, and then flings the disk by extending the wrist, thereby imparting spin to the disk and launching the disk through the air. A Frisbee™ is capable of remaining aloft for a relatively long time given its peripheral mass distribution and its aerodynamic structure Other flying toys are known such as the aerial disk disclosed in U.S. Pat. No. 2,744,356 (issued to Killinger et al.). The aerial disk disclosed by Killinger et al. comprises two plate-like members peripherally joined together and a receptacle mounted in the interior of the joined plate-like members, with the receptacle recited to contain a parachute that is freely released from the receptacle during flight of the aerial disk.

Another aerodynamic toy is disclosed in U.S. Pat. No. 3,855,728, issued to Hynds. This aerodynamic toy comprises a pair of disks, with one disk nested within a first disk such that the disks separate in flight. In practice, the smaller nested disk follows the larger disk after separation in flight and both land in substantially the same vicinity.

U.S. Pat. No. 4,077,155, issued to Bruntmyer, discloses an aerodynamic toy comprising a disk-shaped throwing implement having a detachable member that detaches from the implement after a certain number of revolutions. The member is made detachable by carrying a nut, which threadably engages a threaded shaft coaxially secured to the rotational axis of the throwing implement. The member is preferably in the shape of a human and is capable of floating to the ground after detachment by means of a connected parachute.

Another flying toy is disclosed in U.S. Pat. No. 4,944,707, issued to Silverglate and assigned on its face to OddzOn Products, Inc. This toy includes outer and inner concentric deformable boundary structures, with an airfoil web joining the structures. The toy deforms in flight to form a variety of shapes.

U.S. Pat. No. 3,758,985, issued to Heisler, discloses a hollow inflatable discus toy. This toy is a hollow disk which attains a shape similar to a "flying saucer" when the inflatable semi-spherical members are inflated by air scoops located in the outer rim of the disk. The spinning action of the toy causes the air scoops to direct air into the hollow regions of the toy. The shape of the toy and its aerodynamic characteristics are altered in flight and are also controlled by the method of throwing the toy.

Other flying toys include the "Illuminated Frisbee Toy" disclosed in U.S. Pat. No. 4,301,616, issued to Gudgel. This toy comprises a typical Frisbee™ disk that is modified to have battery-powered light emitting diodes connected by optical fiber guides at its center to create illuminated areas about the toy. U.S. Pat. No. 5,490,047, issued to O'Rourke et al., discloses an illuminated ball having a light source extending from its center. U.S. Pat. No. 4,894,038, issued to Giese, discloses a Frisbee™ and ball drop assembly, with the ball drop assembly being carried on the wall of the Frisbee disk at its center for dropping a ball from the concave wall thereof during flight on command from a remote control transmitter.

Finally, U.S. Pat. No. 5,480,143, issued to McMurry, teaches a "Winged Practice Ball" having plurality of connecting wings that skeletally define the shape thereof.

Thus, a variety of aerodynamic toys are known. Many of the toys combine a common Frisbee™-type disk with a separate toy feature for added interest during play; for example, the above-described references add such toy features as parachuted figures, nested disks, remote-control ball drops, and illumination to the basic Frisebee™ design. However, none of the above-described references disclose a simple one-piece toy that combines the aerodynamic features of a disk-shaped throwable toy and the fullness of a ball or rounded toy which can either be thrown or kicked.

Accordingly, it would be desirable to develop a toy that offers at once the features of a disk-shaped aerodynamic toy and a ball in a form that is sufficiently light to be easily grasped, thrown or kicked, and caught. The toy should also permit a person having limited manual dexterity, such as a young child or a physically challenged person to find enjoyment playing with the toy. Finally, the toy should be capable of easy and inexpensive manufacture.

DISCLOSURE OF INVENTION

In accordance with the invention, the throwable toy is disclosed that combines the features of a disk-shaped flying toy with the features of a ball or rounded toy. Specifically, the toy comprises a disk-shaped portion circumscribed by a rounded rim, with the rim having a topside lying in a first plane and the a bottom side lying in a second plane that is substantially parallel to the first plane. The ball-like feature of the toy is provided by a pair of like-shaped convexities that protrude from the first and second planes in an opposing fashion and that adjoin the disk-shaped portion. Each of the convexities is concentric to the circular rim of the toy.

The present aerodynamic toy offers a unique play experience. It combines the ease of handling and aerodynamics experienced with a disk-shaped toy, such as a Frisbee™, with the fullness of a ball or rounded toy. Thus, the present toy may be thrown in the manner of a Frisbees and kicked in the manner of a ball. Advantageously, the present toy lands in a substantially identical fashion each time it is thrown, given that each side of the disk-shaped portion has a like-shaped protruding convexity. As such, one can expect perfect landings from the present toy with each throw or kick. In comparison, plain saucer-shaped flying toys may land upside-down.

The present toy may be made of any material that is sufficiently light in weight to allow an individual to throw it in the manner of a Frisbee™. The toy should be made of a semi-rigid material such that it maintains its shape during play. The toy flexes upon impact but returns to its manufactured shape. The simplicity of its one-piece design allows for inexpensive manufacturing by known processes, such as injection molding.

BEST MODES FOR CARRYING OUT THE INVENTION

In accordance with the invention, a throwable and aerodynamic toy is provided that combines the ready handling of a flying disk with fullness of a ball or rounded throwing toy. Specifically, the present throwable toy comprises a one-piece molded device with a disk-shaped region circumscribed by a rounded rim having a top side and a bottom side, with the topside of the rim lying in a first plane and the bottom side lying in a second plane that is substantially parallel to said first plane. The toy further comprises a pair of regions consisting of like-shaped protruding convexities, said convexities protruding from the first and second planes in an opposing fashion and adjoining the disk-shaped portion, with both convexities being centered about the axis at the center of said disk-shaped portion and perpendicular to said first and second planes. In other words, the convexities are concentric to the disk-shaped portion. When in flight, the toy has the appearance of a "flying saucer" or unidentified flying object, giving it added play appeal. The toy may be thrown in the manner of a Frisbee™ or kicked in the manner of a ball.

Figure 1:
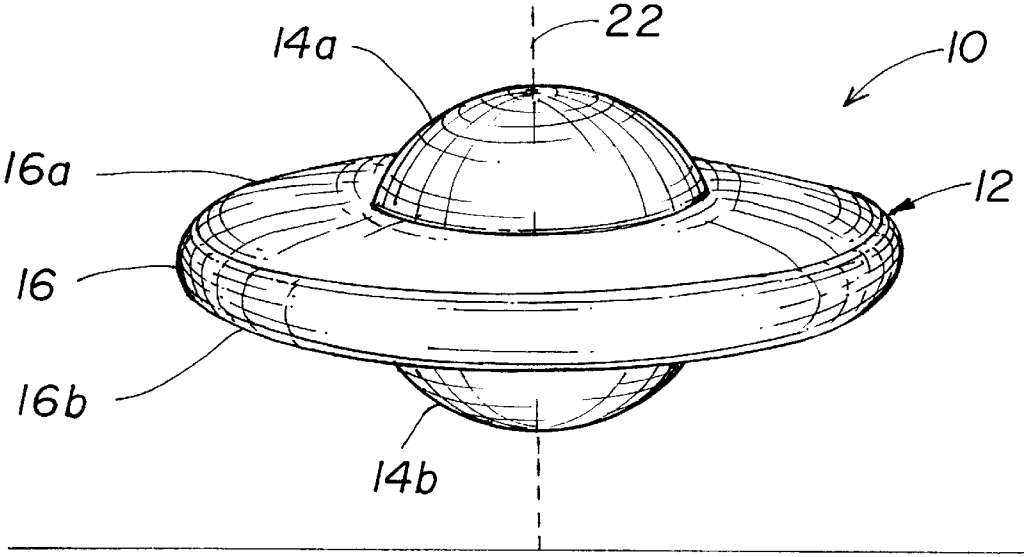
FIG. 1 is a perspective view of a preferred embodiment of the present toy device in which the convexities protruding from the opposing planes of the circular disk region are semi-spherical in shape.

The invention is best understood with reference to the drawings, in which like numbers represent like parts throughout the several views. Turning now to FIG. 1, a preferred embodiment of the present aerodynamic toy 10 is depicted. In this embodiment, there is a disk-shaped region 12 and a pair of regions consisting of like-shaped convexities 14*a,b* that are semi-spherically shaped. The disk-shaped portion 12 is circumscribed by a rim 16. The convexity 14*a* protrudes from the plane 18 shown as dashed lines in FIGS. 2 and 3) in which the top 16*a* of the rim 16 lies while the convexity 14*b* protrudes from the plane 20 (shown as dashed lines in FIGS. 2 and 3) in which the bottom 16*b* of the rim 16 lies. The convexities 14*a,b* are concentric to the disk-shaped portion about the axis 22 (shown in dashed lines) running through the center of the disk-shaped portion perpendicular to planes 18 and 20.

The disk-shaped region 12 is therefore of a substantially circular outline, and it may assume any appropriate diameter, such for example as about ten inches, a conventional to Frisbees™ to be thrown through the air from one person to another. It may likewise assume any appropriate thickness (i.e., the distance between the top 16*a* and bottom 16*b* of the rim), but is preferably within the range of about one to two inches in thickness so that it may be comfortable gripped by the user.

The like-shaped convexities 14*a,b* protruding from planes 18 and 20 may assume the shape of a semi-sphere or a cone. Preferably, the like-shaped convexities 14*a,b* are semi-spheres such as depicted in FIG. 1. The semi-spherically-shaped convexities 14*a,b* are preferred because of the resulting "flying Saucer" appearance of the toy 10 as well as for the superior bouncing qualities of the toy 10 upon landing.

Figure 4:
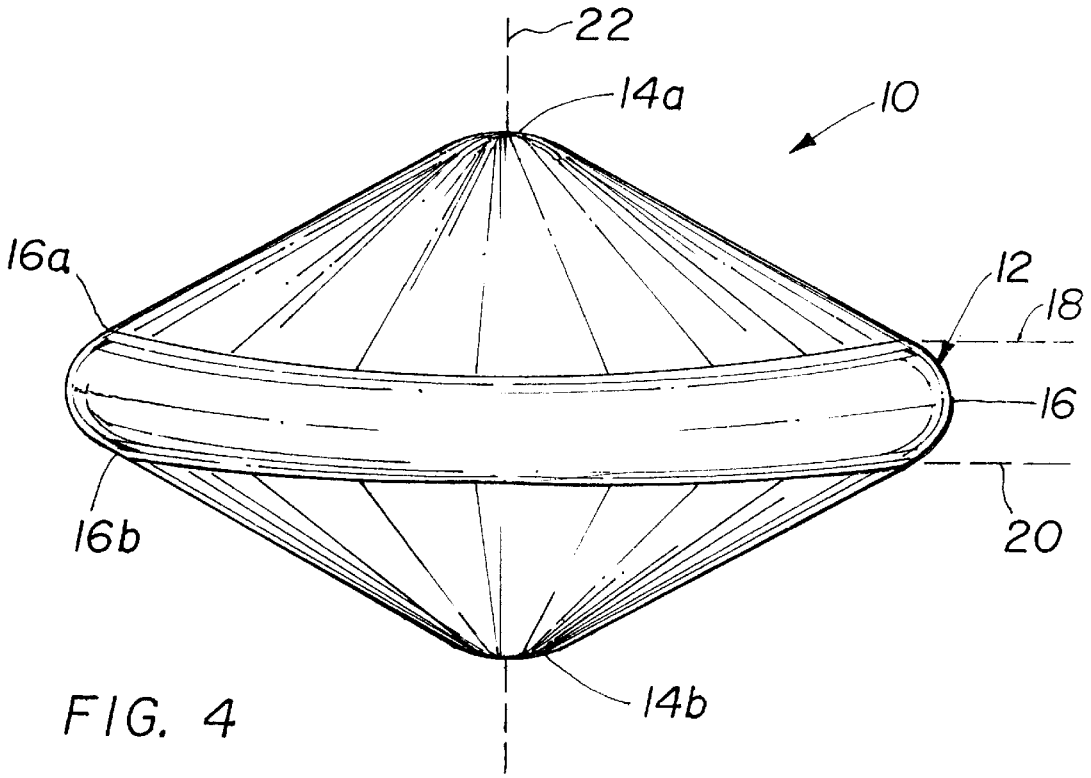
FIG. 4 is a side view of an alternative embodiment of the present toy device in which the convexities protruding from the opposing planes of the circular disk region are a rounded conical shape.
Figure 5:
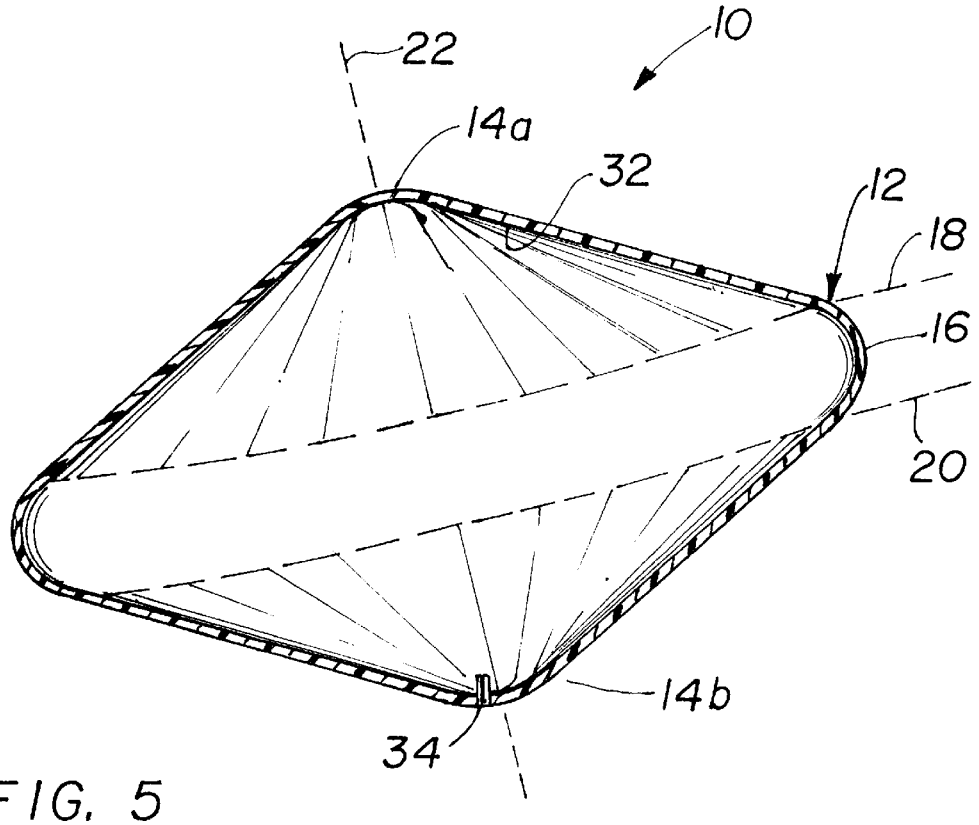
FIG. 5 is a sectional view of an alternative embodiment of the present toy device in which the toy is hollow and the convexities protruding from the opposing planes of the circular disk region are a rounded conical shape.

In the alternative embodiment of FIG. 4, the like-shaped convexities 14*a,b* are rounded cones, with the base of the cones being joined to the disk-shaped portion 12, preferably at the top 16*a* and bottom 16*b* of the rim 16 respectively. The cone-shaped convexities 14*a,b* offer an advantage over semi-spherically-shaped convexities; a toy device 10 having cone-shaped convexities 14*a,b* as shown in FIG. 4 is capable of achieving higher and longer flight trajectories compared to toy devices 10 with semi-spherically-shaped convexities due to its better aerodynamic qualities.

The like-shaped convexities 14*a,b* may protrude from the disk-shaped portion 12 at any point along the substantially circular area lying in planes 18,20 and circumscribed by rim 16. For example referring to FIG. 2, the disk-shaped portion 12 comprises the rim 16, an upper surface 24 lying in plane 16, and a lower surface 26 lying in plane 20. Therefore, in the embodiment depicted in FIG. 2, the like-shaped convexities 14*a,b* protrude from a point on planes 18,20 in between the rim 16 and the center axis 22; hence, the disk-shaped portion 12 comprises upper and lower surfaces 24,26 between the rim 16 and the convexities 14*a,b*. In comparison, the embodiment depicted in FIG. 4 comprises like-shaped convexities 14*a,b* protruding form the circumference of the disk-shaped portion 12 at the rim 16 itself, thereby obviating the need for fill-in surfaces 24,26 between the rim 16 and the convexities 14*a,b*.

Figure 2:
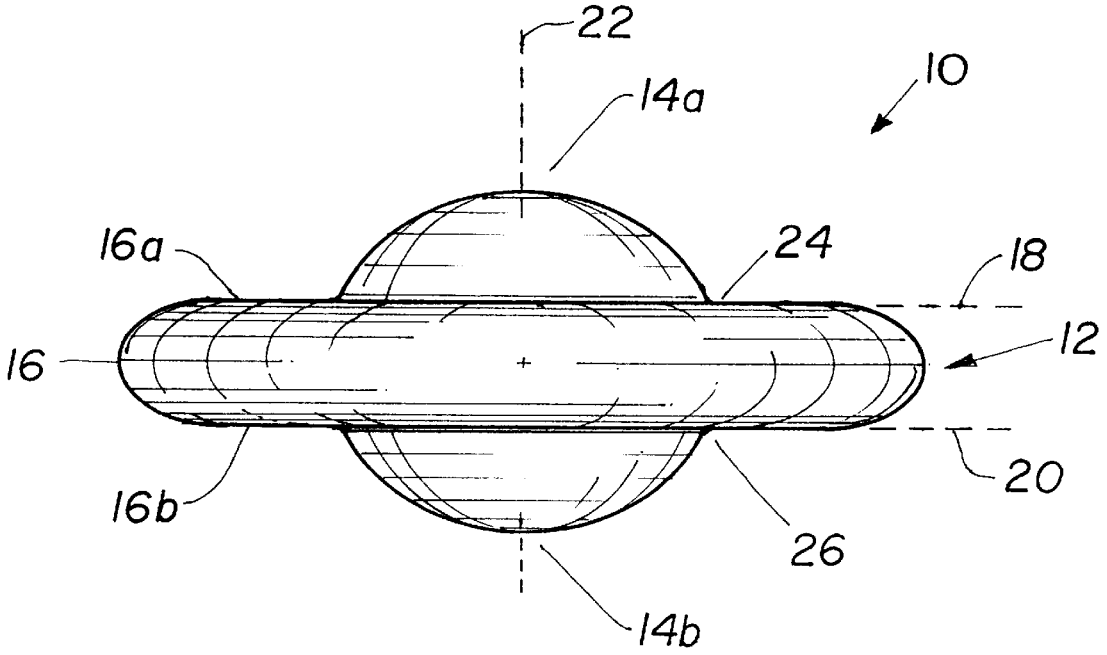
FIG. 2 is a side view of a preferred embodiment of the toy device depicted in FIG. 1, in which the convexities protruding from the opposing planes of the circular disk region are semi-spherical in shape.
Figure 3:
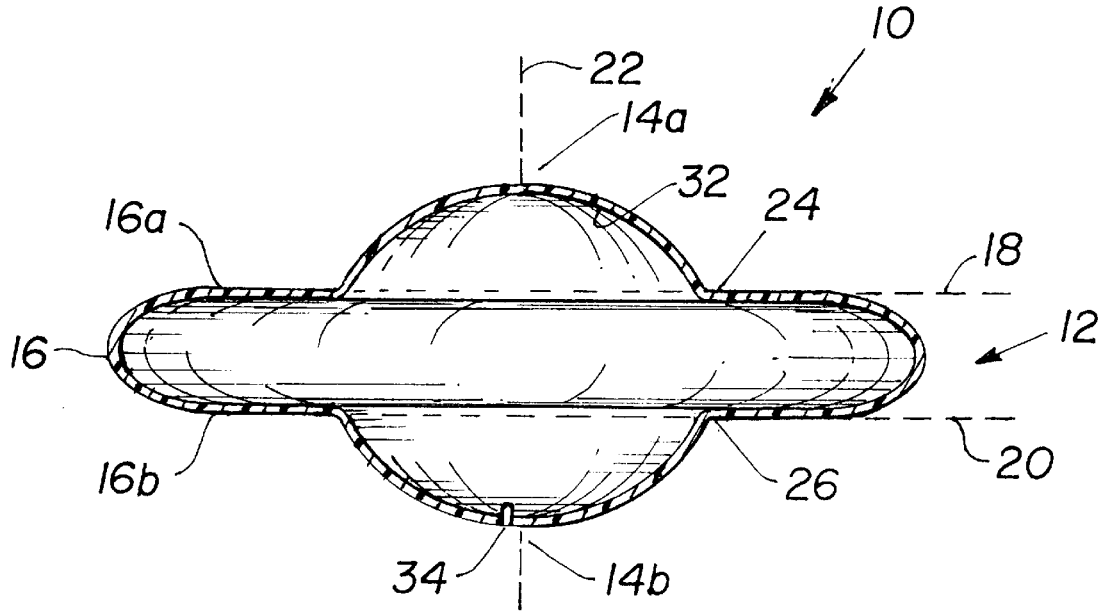
FIG. 3 is a sectional view of a preferred embodiment of the present toy device in which the toy is hollow and the convexities protruding from the opposing planes of the circular disk region are semi-spherical in shape.

The toy device 10 comprises a single unit. Referring to FIG. 2, the disk-shaped portion 12 comprises the rim 16, an upper surface 24 lying in plane 18, and a lower surface 26 lying in plane 20 and the like-shaped convexities 14*a,b* are formed out of a continuation of the upper and lower surfaces 24,26. Thus, the toy device 10 is a single continuous unit of material 32 such as a molded or shaped substantially rigid material (such as plastic, wood or foam) or a flexible material (such as foam rubber or plastic).

The toy device 10 may be either hollow or semi-solid, so long as the surface 32 is substantially rigid to retain the shape of the toy device 10 during use and is sufficiently light in weight for throwing. Nonexclusive examples of substantially rigid materials that might form a solid toy device 10 include foam, plastics, and rigid papers such as cardboard. While the toy device 10 may comprise heavier materials such as wood or metal, it is contemplated that a toy device 10 comprising such materials would be hollow rather than solid, so that the weight of the toy is not excessive for throwing.

If a soft, flexible material is employed to form the toy device 10, the toy device 10 would be semi-solid and the flexible material would have sufficient rigidity such that the toy device 10 substantially retains its shape during use.

In a semi-solid toy device 10 the material used to form the toy device 10 can have a density which can be controlled and varied within the toy. By carefully choosing the density of the material for the various regions within the toy device 10, the toy device 10 can be designed to have different flight characteristics. For example, if a toy device 10 having the capability of sustained flight is desired, the density of the material near the rim 16 will be greater than the density of the material near the center axis 22.

Figure 6:
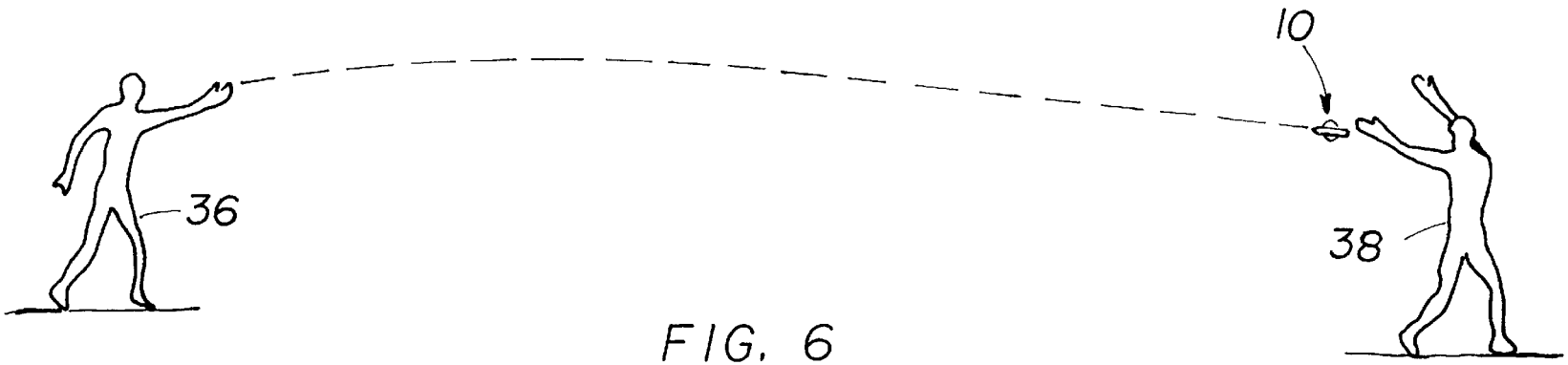
FIG. 6 is a diagrammatical side view of two persons throwing the toy depicted in FIG. 1 back and forth in a game of catch.

In use, the toy device 10 described is thrown into the air with a spinning motion imparted thereto by grasping the disk-shaped portion 12 of the toy with the fingers, More specifically, the device 10 is preferably grasped in one hand with the thumb carried on top of the disk 12 and the four fingers pressing against the bottom of the disk 12. The device 10 is then typically projected into the air in a wrist-snapping motion. Consequently, during an airborne flight, the device rotates about its axis 22 of rotation. The angle at which the disk 12 is held controls the particular flight trajectory assumed by the toy device 10. Typically, the device 10 is propelled in an upwardly arching flight pattern with the device being held aloft aerodynamically for a time until assuming a down ward trajectory toward the earth. FIG. 6 depicts the toy device 10 as it is contemplated for use by individuals; the individuals 36,38 are shown tossing the device 10 back and forth in the manner of throwing a Frisbee™.

For an interesting feature during play, the toy device 10 may be made to bounce upon impact with the ground, such as by forming the toy device 10 from a material which deforms upon impact and springs back to its original shape. The toy device 10 can achieve this feature of bouncing upon impact with the ground in either a hollow or semi-solid construction. Another optional feature is contemplated to be its illumination from within during play. Specifically, the toy device 10 could be hollow and made of a translucent material, such as plastic or foam, and an illuminating means could be positioned internally in the device 10 in the manner of U.S. Pat. No. 4,301,616, issued to Gudgel and described above. In Gudgel, a Frisbee™ is made of translucent plastic material and its has battery-powered light emitting diodes to provide illumination. In the same fashion, battery powered light emitting diodes could be placed internally in the translucent body of the present toy device 10 to enable nighttime play.

Thus, there has been disclosed a one-piece aerodynamic toy that combines features of conventional disk-shaped flying toys with rounded throwing objects such as balls. It will be readily apparent to those skilled in the art that various changes and modifications of an obvious nature may be made without departing from the spirit of the invention, and all such changes modifications are considered to fall within the scope of the invention as defined by the appended claims.

What is claimed is:

1. A throwable toy comprising:

a disk-shaped member circumscribed by a rounded rim, said disk-shaped member having a top side lying in a first plane and a bottom side lying in a second plane, said first and second planes being substantially parallel; and top and bottom convex members, the top convex member being defined by a portion of a top semi-sphere having a center located along a primary axis of the disk-shaped member truncated by an intersection with said first plane, and the bottom convex member being defined by a portion of a bottom semi-sphere having a center located along said primary axis of the disk-shaped member truncated by an intersection with said second plane;

wherein the disk-shaped member and the top and bottom convex members constitute a semi-rigid, integral body of unitary construction.

2. The throwable toy in accordance with claim 1 wherein said toy is made of an expanded foam type plastic.

3. The throwable toy in accordance with claim 1 wherein said toy is made of a foam rubber.

4. The throwable toy in accordance with claim 1 wherein said toy is molded.

5. The throwable toy in accordance with claim 1, wherein said toy is made of a material having a variable density within the toy.

6. The throwable toy in accordance with claim 5 wherein the density of the material from which it is made is greater adjacent to the rounded rim of the disk-shaped member to achieve a longer flight trajectory, greater stability, and a flight of longer duration.

7. The throwable toy in accordance with claim 5 wherein the density of the material from which it is made is greater adjacent to said primary axis of the disk-shaped member of the toy to achieve a longer trajectory when the toy is kicked.

8. A throwable toy comprising:

a disk-shaped member circumscribed by a rounded rim, said disk-shaped member having a top side lying in a first plane and a bottom side lying in a second plane, said first and second planes being substantially parallel; and top and bottom convex members, the top convex member being defined by a portion of a top semi-sphere having a center located along a primary axis of the disk-shaped member truncated by an intersection with said first plane, and the bottom convex member being defined by a portion of a bottom semi-sphere having a center located along said primary axis of the disk-shaped member truncated by an intersection with said second plane;

wherein the disk-shaped member and the top and bottom convex members constitute a semi-rigid, integral skin of unitary construction.

9. The throwable toy in accordance with claim 8 wherein said toy is made of an expanded foam type plastic.

10. The throwable toy in accordance with claim 8 wherein said toy is made of a foam rubber.

11. A throwable toy comprising:

a disk-shaped member circumscribed by a rounded rim, said disk-shaped member having a top side lying in a first plane and a bottom side lying in a second plane, said first and second planes being substantially parallel; and top and bottom convex members, each convex member having a cone shape with a rounded top and coaxial with a primary axis of the disk-shaped member, the top convex member having a base lying in said first plane and the bottom convex member having a base lying in said second plane;

wherein the disk-shaped member and the top and bottom convex members constitute a semi-rigid, integral body of unitary construction.

12. The throwable toy in accordance with claim 11 wherein said toy is made of an expanded foam type plastic.

13. The throwable toy in accordance with claim 11 wherein said toy is made of a foam rubber.

14. The throwable toy in accordance with claim 11 wherein said toy is molded.

15. The throwable toy in accordance with claim 11, wherein said toy is made of a material having a variable density within the toy.

16. The throwable toy in accordance with claim 15 wherein the density of the material from which it is made is greater adjacent to the rounded rim of the disk-shaped member to achieve a longer flight trajectory, greater stability, and a flight of longer duration.

17. The throwable toy in accordance with claim 15 wherein the density of the material from which it is made is greater adjacent to the primary axis of the disk-shaped member of the toy to achieve a longer trajectory when the toy is kicked.

18. The throwable toy in accordance with claim 11 wherein said integral body of unitary construction is hollow.

19. The throwable toy in accordance with claim 18 wherein said toy is made of an expanded foam type plastic.

20. The throwable toy in accordance with claim 18 wherein said toy is made of a foam rubber.

* * * * *